US005180167A

United States Patent [19]

Felix

[11] Patent Number: 5,180,167

[45] Date of Patent: Jan. 19, 1993

[54] GOLF SWING PRACTICE NET

[76] Inventor: Clifford J. Felix, 6220 Twin Tree Place, Richmond, British Columbia, Canada, V7C 4A4

[21] Appl. No.: 823,325

[22] Filed: Jan. 21, 1992

[51] Int. Cl.[5] ..... A63B 69/36

[52] U.S. Cl. ..... 273/181 F; 273/406; 273/410

[58] Field of Search ..... 273/181, 406, 407, 410, 273/411, 35, 176, 182; 135/112

[56] References Cited

U.S. PATENT DOCUMENTS

| | | | |
|---|---|---|---|
| 1,218,390 | 3/1917 | Gates . | |
| 1,430,280 | 9/1922 | Bolton . | |
| 1,788,803 | 1/1931 | MacGeorge . | |
| 2,043,273 | 6/1936 | Watson . | |
| 2,397,921 | 4/1946 | Cole | 273/410 |
| 2,458,105 | 1/1949 | Sell | 273/181 A |
| 2,818,028 | 12/1957 | White | 135/112 |
| 2,895,737 | 7/1959 | Blees . | |
| 2,915,314 | 12/1959 | Phillips | 273/410 |
| 3,197,208 | 7/1965 | Makar . | |
| 3,896,719 | 10/1976 | Lee | 273/181 F |
| 4,381,110 | 4/1983 | Balaz | 273/181 F |
| 4,511,146 | 4/1985 | Windall | 273/181 F |
| 4,538,814 | 9/1985 | Cunningham | 273/181 F |
| 4,723,780 | 2/1988 | Vinzetta | 273/181 A |
| 4,750,744 | 6/1988 | Michalec | 273/181 A |
| 4,949,979 | 8/1990 | Wheatcroft | 273/181 F |
| 5,088,740 | 2/1992 | Peterson | 273/181 F |

FOREIGN PATENT DOCUMENTS

| | | | |
|---|---|---|---|
| 934599 | 8/1963 | United Kingdom | 273/181 F |
| 1158596 | 7/1969 | United Kingdom | 273/35 |
| 2180163 | 3/1987 | United Kingdom | 273/181 F |

*Primary Examiner*—Mark Graham
*Attorney, Agent, or Firm*—Barrigar & Oyen

[57] ABSTRACT

A golf swing practice device has a netting supported from a frame to provide a wedge-shaped pocket. The length of the sides of the wedge are adjustable to permit the open end of the wedge to be rotated by rotating the portion of the frame supporting the open end of the wedge with respect to the portion of the frame supporting the length of the wedge to permit a golfer to stand within the opening while avoiding the frame of the opening with his swing.

33 Claims, 6 Drawing Sheets

GOLF SWING PRACTICE NET

FIELD OF THE INVENTION

This invention relates to the field of golf practice devices, and in particular, golf swing practice nets into which golf balls may be driven.

BACKGROUND OF THE INVENTION

Golfing is a sport which requires practice. A well practised golf swing is an important element of successful golfing. Improvements in swing technique, and practice of that technique, are required in order for a golfer to improve his or her performance. However, green fees are expensive and a golfer does not always have convenient access to a golf course or driving range in which to practise. Consequently, there exists a need for a device which allows a golfer to practise his or her golf swing within a confined area such as a back yard or garage.

A primary consideration in the design of such a device is safety. Golf balls when driven at full force are potentially lethal projectiles, and when used within a confined space represent a potential danger not only to people within the immediate vicinity, but also to the golfer. Thus a golf swing practice device must prevent the golf ball from becoming a dangerous projectile once the golf ball is hit by quickly arresting the motion of the golf ball so as to dissipate the golf ball's energy. The device must also minimize the possibility of potentially dangerous rebounding of the golf ball from the device. Advantageously, a golf swing practice device must be constructed of a minimum of materials to reduce manufacturing cost, and must be easily assembled and disassembled for convenience of use.

In the prior art, Gates U.S. Pat. No. 1,218,390, issued Mar. 6, 1917, discloses a pyramid-shaped receptacle made of canvas or the like that is stretched over a pyramid-draped skeletal frame. In use, the frame is mounted on a folding wooden frame. The receptacle is made up of four triangular canvas sides suitably stitched or seamed together so that the sides converge to a vertex attached to one end of the folding wooden frame. Light bamboo poles are used to stretch open the mouth of the receptacle at the opposite end of the wooden frame. The pyramid shape is suspended on its side by attachment of the skeletal frame to the folding wooden frame so as to provide a funnel for arresting the flight of golf balls driven into the receptacle.

More recently, Balaz U.S. Pat. No. 4,381,110, issued Apr. 26, 1983, teaches a golf trainer device for arresting the flight of golf balls. The device consists of a pair of generally planar rectangular frame sections arranged in a side-by-side vertical configuration. The rectangular frame sections are connected at a common vertex and arranged so that they form a V-shape in horizontal cross-section. Nets are suspended across the top, bottom and sides of the frame sections by rings looped over the frame members. The nets are sewn together to form a tapered sack which is wedge-shaped when suspended from the frame. A vertical flexible sheet suspended between the horizontal top and bottom nets presents a flat impact area to the user to absorb the impact of a golf ball driven into the tapered sack.

Both the Gates and Balaz devices have inherent disadvantages. Experience and common sense dictates that, in order for golf practice devices to be useful and safe, the interior of a ball arresting receptacle cannot have exposed rigid surfaces from which a golf ball may rebound. Further, such a receptacle must have a large enough opening so as to virtually eliminate the possibility of a golf ball missing the opening of the receptacle when driven towards the receptacle, and the receptacle must be deep enough and of sufficient energy damping construction so that a golf ball driven into the receptacle will be quickly and safely arrested in flight.

The Gates and Balaz devices would, if made large enough, accomplish at least the latter objective. That is, in both cases, if the structural framework was made large enough so that a golfer could stand at least partially inside the opening of the framework so that the golf ball could be driven from the front lip of the receptacle into the receptacle, then the possibility of the golf ball missing the opening of the receptacle would be virtually eliminated. This, of course, would require that the structure be large enough to accommodate a full golf swing, which means that the opening of the structure would have to be both tall enough and wide enough to accommodate the golf swing follow-through. If the size of the Gates and Balaz devices were increased in this manner they would be unmanageably large and thus inconvenient to use in a golfer's garage or back yard.

Further, the Gates and Balaz devices incorporate rigid longitudinal frame members which extend from the front opening frame members rearwardly so as to support the tapering sides of the golf ball receptacle in close proximity to the longitudinal members. In both cases, the energy of a golf ball driven into the golf ball receptacle is likely sufficient to drive the flexible receptacle material against the longitudinal members, thereby exposing the golfer to the risk of being hit by a rebounding golf ball.

The present invention is a simple golf practice device which minimizes the risk of a golf ball driven into the device rebounding out of the device. The device is quickly and simply assembled and disassembled using a minimum of materials, is small enough so that such a device may be safely used in a golfer's back yard, garage or like enclosure and large enough to permit an uninhibited golf swing.

SUMMARY OF THE INVENTION

A golf swing practice device comprises a frame and a net having a mesh adapted to prevent passage of a golf ball. The frame is adapted to support the net to form a wedge shape having a planar open end opposite the apex of the wedge. The open end is large enough to receive a standing golfer. The plane of the open end is rotatable with respect to a vertical axis lying in the plane containing the planar open end.

The golf swing practice device comprises first and second frame elements. The first frame element is large enough so that a golfer may stand within the first frame element when that first frame element is in a substantially upright position. The first frame element comprises a first generally horizontally extending member and first and second leg members extending downwardly at opposed ends of the first horizontal member. The second frame element comprises a second generally horizontally extending member pivotally connected at one end thereof to the first horizontal member for rotation about a vertical axis at a point located centrally on the first horizontal member between the opposed ends thereof. A third leg member extends downwardly from the second end of the second horizontal member.

A pivotable "T"-junction coupling member releasably mountable between the second generally horizontal extending member and the first horizontal member provides the pivotal connection of the second generally horizontally extending member to the first horizontal member. The "T"-junction coupling member has a first coupling member forming the base leg of the "T" for releasable coupling to the second generally horizontally extending member, and a second coupling member forming the top of the "T", pivotally coupled to the first coupling member, for releasable coupling to the first horizontal member. The pivotal coupling allows pivotal rotation of at least 10 degrees between the first and second coupling members.

Flexible means such as ropes extend between the second end of the second horizontal member and each of the opposed ends of the first horizontal member for suspending the net from the frame. The length of the ropes between the second end of the second horizontal member and either of the opposed ends are releasably adjustable. The ropes are tensioned by tensioning means such as releasably slidable toggles which are releasably slidable along the ropes. The ropes are slidably attached to the frame by rings mounted on the rope.

The net is attachable to the first frame element by rings attached to the front of the net which are free to slide along the first horizontally extending member and the first and second leg members. The net is suspended from the ropes by weaving the ropes through the webbing of the net and allowing the sides of the net to hang naturally from the ropes so that the net forms a wedge-shaped golf ball receptacle.

Advantageously, the "T"-junction coupling member further comprises a means for retaining the rings on the "T"-junction coupling member.

BRIEF DESCRIPTION OF THE DRAWINGS

In drawings which illustrate embodiments of the invention.

DETAILED DESCRIPTION OF PREFERRED EMBODIMENTS

The ideal structure which would allow a golfer to practise his or her golf swing would be a large, completely enclosed, soft-sided cage. The golfer would merely stand inside the cage and freely swing so as to drive a golf ball from one end of the cage to the other. However, for practising golf at home, such a cage is not feasible. A recreational golfer in order to practise at home often must erect a golf swing practice net for each use, and often has neither the space nor can afford to have a large fully enclosed practice cage which is left standing for the entire golfing season. The present invention provides a simple structure which can be assembled and disassembled quickly and which in use is safe and occupies a fraction of the space required for a fully enclosed practice cage, especially if it is to be used by children or adults of short stature.

The structure consists of a modified tripod frame (hereinafter the "frame") constructed of aluminum tubing for supporting a wedge-shaped net suspended by ropes and rings from the legs of the tripod. The net serves as a golf ball receptacle into which golf balls may be driven (hereinafter the "receptacle"). Two of the tripod legs define a front opening of the receptacle. The third tripod leg is pivotally mounted at the junction between the front two legs and extends rearwards so as to support the vertex of the wedge-shaped net. The tripod legs are bent so that the front opening of the net forms the shape of an inverted "U" (hereinafter the "front subframe"). The rearward extending tripod leg (hereinafter the "longitudinal leg") is bent so that it initially extends substantially horizontally from the pivot connection with the front two legs, and then curves downward in its rearmost portion so as to engage the ground substantially vertically.

The wedge-shaped receptacle is suspended from the front subframe by rings which are free to slide along the tubular members of the subframe. The vertex of the wedge-shaped receptacle is suspended from the longitudinal leg by a single ring which is slid over that member of the frame. Adjustable ropes are strung between the front subframe uprights and the longitudinal leg upright to form a horizontally V-shaped flexible support over which the net may be draped.

Each frame leg is typically constructed of two tubular frame members, an upright member and a horizontal member, the ends of the members adapted to be slidably coupled to one another. The horizontal members are joined at the apex of the tripod to a pivotable "T"-junction by slidable couplings. In one embodiment, the slidable couplings are releasably secured using spring loaded buttons on one member which releasably engage corresponding holes in the other member.

Figure 1:
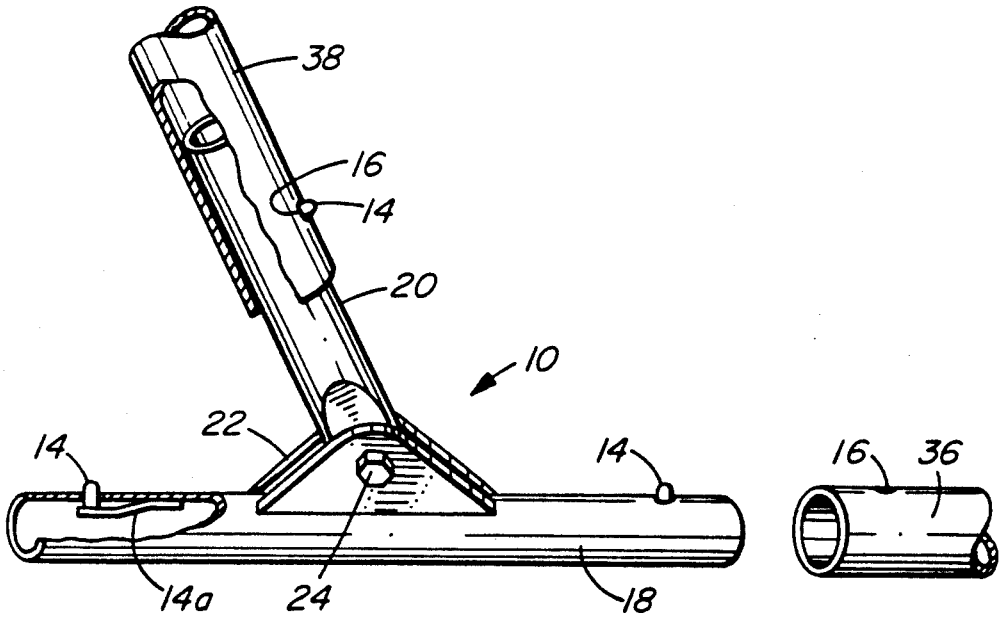
FIG. 1 is a partially cut-away perspective view illustrating a frame member being slidably coupled to a "T"-junction in accordance with the present invention.

With reference now to FIG. 1, "T"-junction 10 slidably engages upper frame members 36, 38. Members 36, 38 are releasably secured to "T"-junction 10 by the engagement of spring loaded pins 14 with corresponding holes 16. "T"-junction 10 comprises front subframe support 18 and longitudinal leg support 20. Support 20 is pivotally connected to support 18 by pivot brace 22 and pivot pin 24. Pivot pin 24 engages a corresponding hole (not shown) in support 20. Spring loaded pins 14 are biased through corresponding holes in support 18, support 20 and through holes 16 in upper frame members 36, 38 by the biasing action of resilient leaf spring 14*a*.

Figure 2:
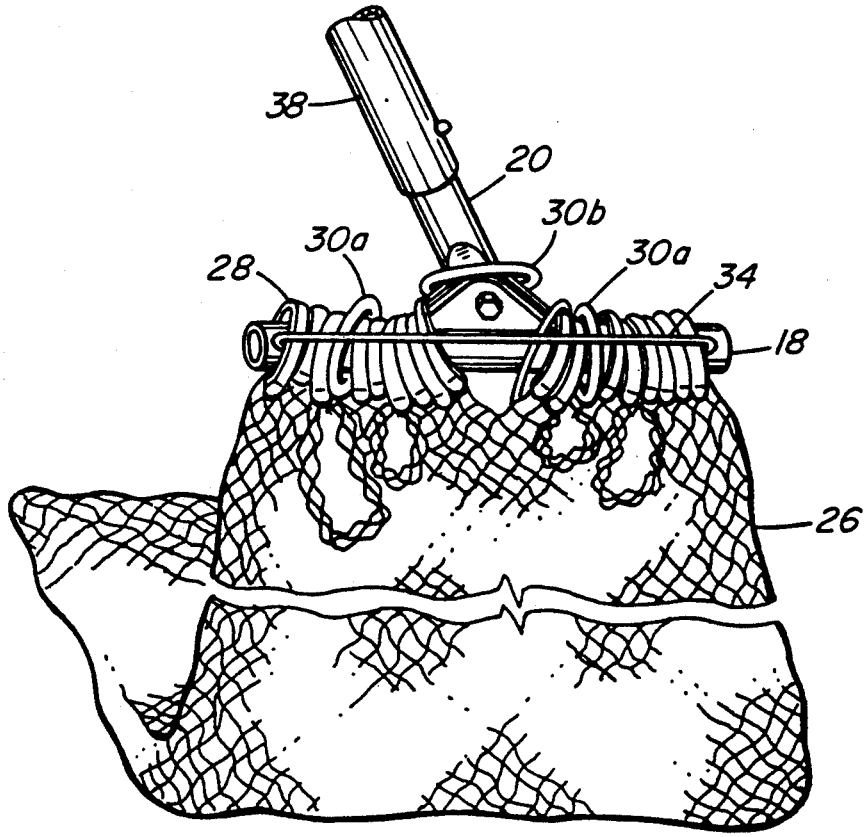
FIG. 2 is a perspective view of the "T"-junction of FIG. 1 and a golf ball arresting net configured for storage.

As illustrated in FIG. 2, when the golf swing practice net of the present invention is disassembled, net 26 may be stored in an orderly fashion by collecting front opening support rings 28 onto support 18. Rope support rings 30*b* are also collected onto support 18 and rope support ring 30*b* onto support 20. There are three rope support rings. Ring 30*b* is collected onto support 20. Two rings 30*a* are collected onto support 18 (one on either side of pivot brace 22). Ropes 32 (seen best in FIGS. 3–6) are suspended between rings 30*a* on support 18 and ring 30*b* on support 20.

Ring retainer 34 is provided to retain rings 28 and 30*a* on support 18. Using ring retainer 34, ropes 32 and net 26 do not have to be untangled every time the golf swing practice net is assembled. Rings 28 are retained in their correct order on front support 18 Retainer 34 may take the form of a double-ended hook as illustrated, or may comprise a clip or tie arrangement. Whatever form of retainer is used, it is satisfactory if rings 28 are firmly retained on support 18 so as to prevent net 26 becoming tangled while the net is stored.

Figure 3:
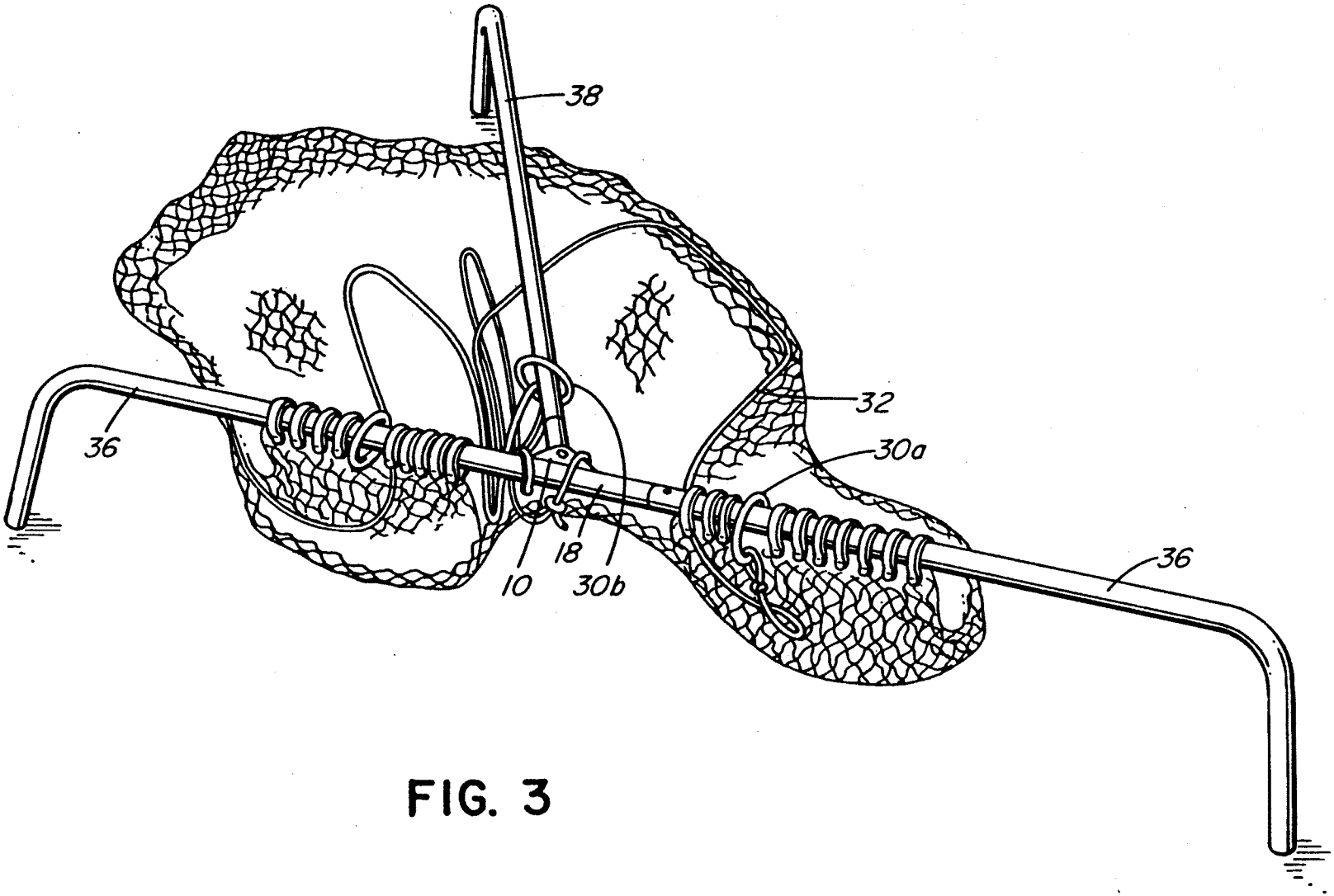
FIG. 3 is a perspective view of the assembled upper frame members with the golf ball arresting net partially deployed.

As illustrated in FIG. 3, the first step in assembling the golf swing practice net is to slidably couple upper frame members 36, 38 to "T"-junction 10. Pins 14 and holes 16 are aligned by depressing pins 14 and sliding members 36, 38 onto "T"-junction 10. Pins 14 lock members 36, 38 into place when pins 14 align with and engage holes 16. In the proper alignment upper frame members 36, 38 extend from a horizontally disposed "T"-junction 10 outwardly in a substantially horizontal direction until they curve downwards near their outermost ends. Front upper frame members 36 which are connected to the left and right sides of support 18 are identical. Rear upper frame member 38 is longer than front upper frame members 36 and extends longitudinally rearwards from support 20. Once front upper members 36 and rear upper member 38 are connected to "T"-junction 10, ring retainer 34 may be removed and rings 28 and 30*a* moved outwardly from "T"-junction 10 along the upper frame members.

Figure 4:
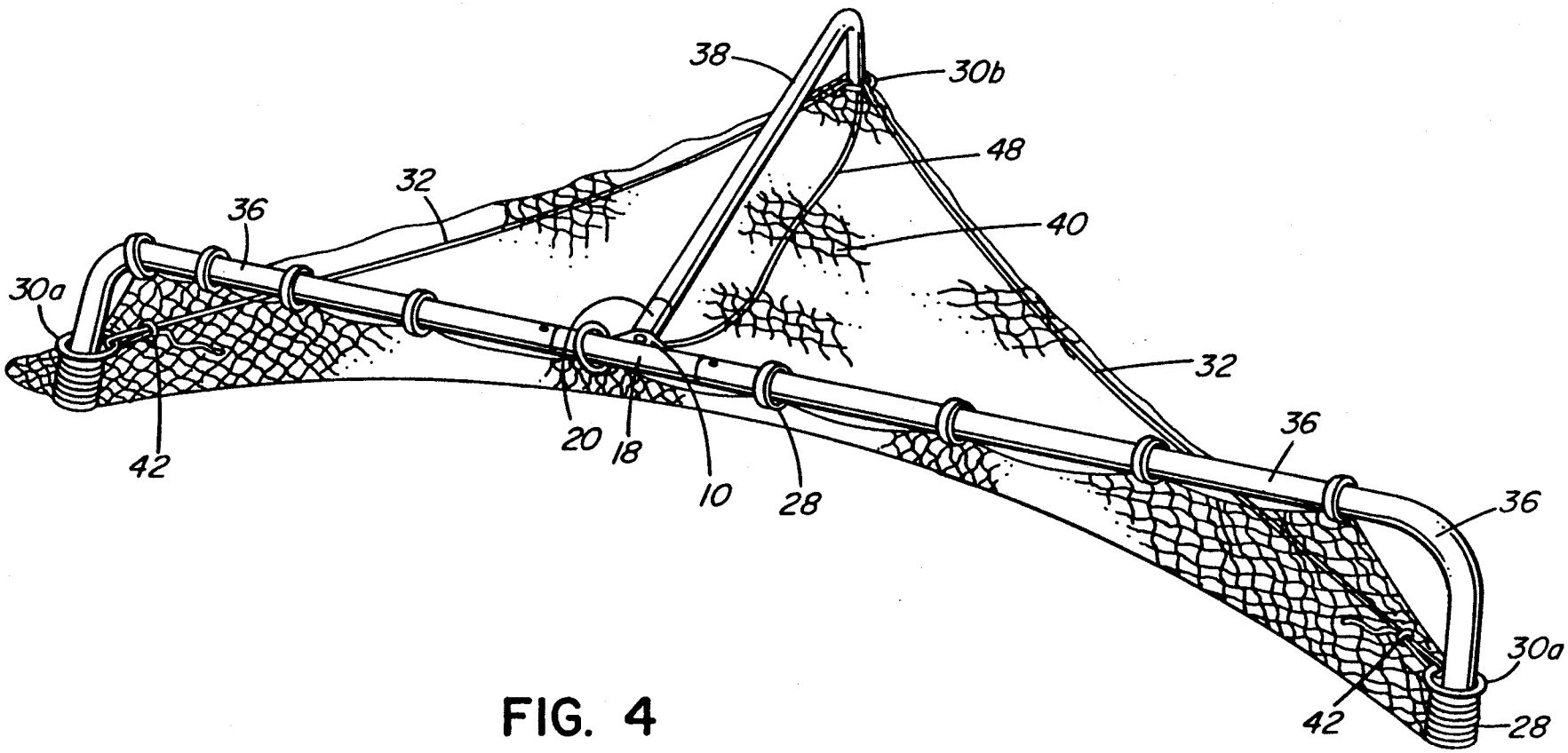
FIG. 4 is a perspective view of the assembled upper frame members illustrated in FIG. 3 with the top portion of the net fully deployed.

FIG. 4 illustrates how front upper frame members 36 and support 18 are initially set at the desired angle relative to support 20 and rear upper frame member 38 by pivoting support 20 relative to support 18 on pivot pin 24. Rings 28 are then spread along front upper frame members 36 so as to tension upper portion 40 of net 26. Ropes 32 are tensioned by sliding tension adjusters 42 so as to brace front upper frame members 36 in the desired angular relation to rear upper frame member 38.

Figure 5:
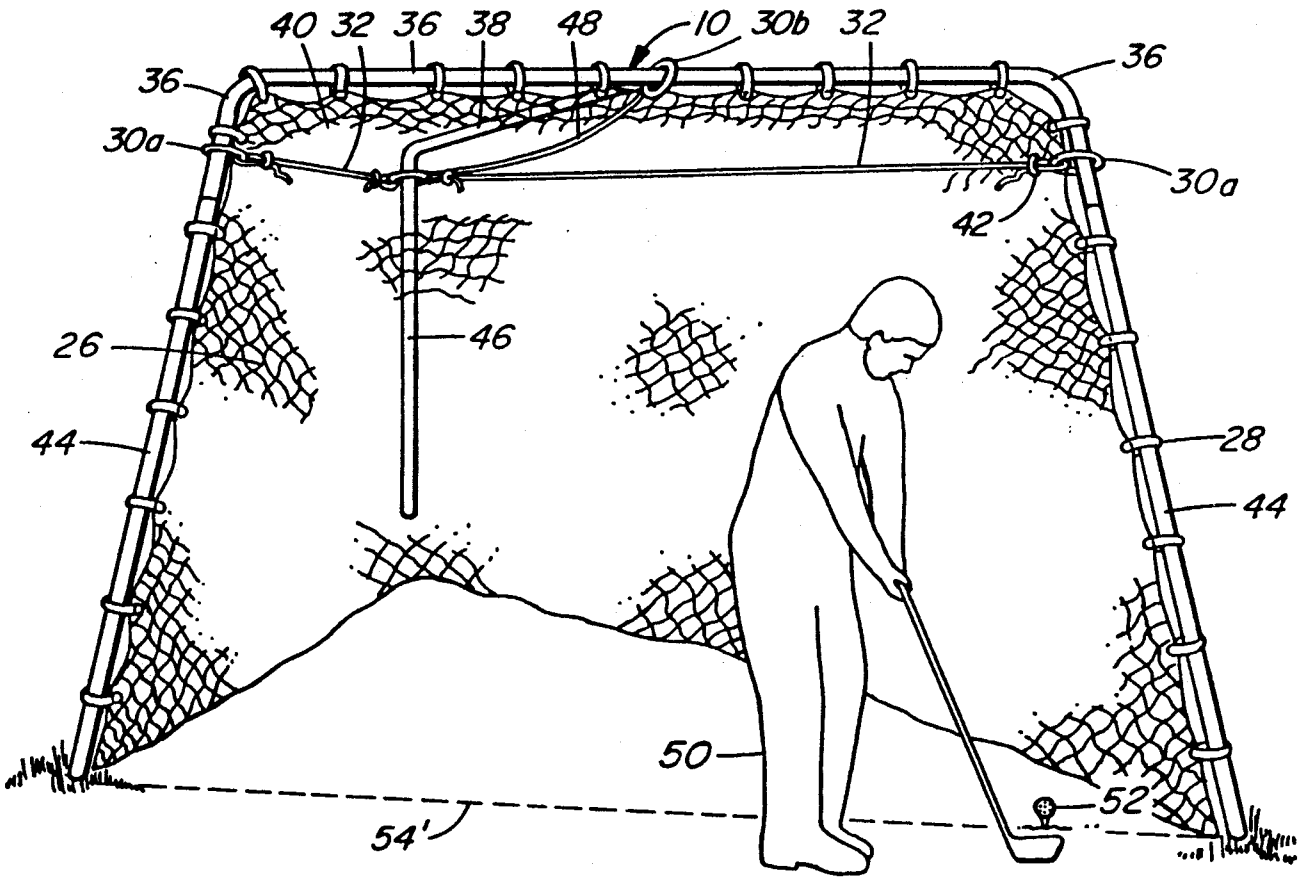
FIG. 5 is a front elevation view of the fully assembled practice net constructed in accordance with the preferred embodiment of the invention.
Figure 6:
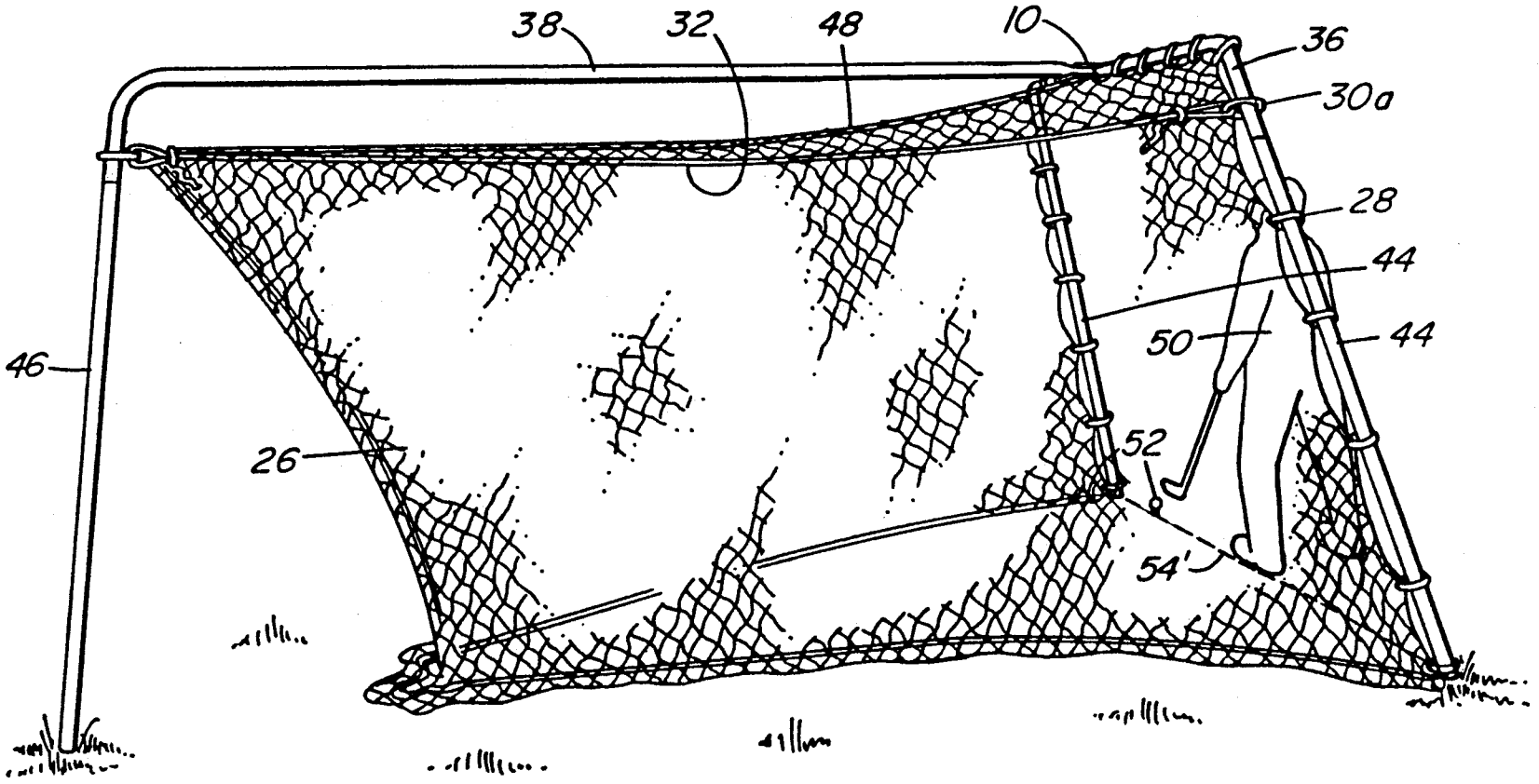
FIG. 6 is a side elevation view of the fully assembled practice net illustrated in FIG. 5.

FIGS. 5 and 6 illustrate the result of slidably connecting front lower frame members 44 to the downwardly curved ends of front upper frame members 36 and of slidably connecting rear lower frame member 46 to the downwardly curved end of rear upper frame member 38. Front lower frame members 44 are connected to front upper frame members 36 while restraining rings 28 from falling. Once members 44 are connected to members 36, rings 28 and net 26 are allowed to fall naturally so that rings 28 are arrayed in spaced array along members 36 and 44 and net 26 hangs to the ground from ropes 32.

Members 44 and 46 may be swaged at their upper and lower ends so as to slidably connect with members 36 and 38, and with extension sections (not shown). The extension sections may be slidably connected to the lower ends of members 44 and 46 so as to increase the height of the cross bar member 36 above a golfer 50.

Net 26, supported by rings 28 on members 44 and 36, defines the front opening of the golf swing practice net. Ropes 32 may be woven through net 26 to support and tension upper portion 40 of net 26. A third rope 48 is suspended between "T"-junction 10 and rope support ring 30*b* (ring 30*b* having been slid to the outermost end of rear upper frame member 38 during the coupling of rear upper frame member 38 onto "T"-junction 10). Rearmost rope support ring 30*b* is held in place by the tension maintained in ropes 32 and 48 by rope tension adjusters 42. Ring 30*b* is positioned sufficiently low enough on rear lower frame member 46 so that the force of a ball driven up into the upper portion 40 of net 26 will not deform the net so as to contact rear upper frame member 38. The tension in ropes 32 and 48 prevents a golf ball from driving rearmost rope support ring 30*b* into contact with either member 38 or member 46.

Ropes 32 thus maintain net 26 in a wedge-like shape into which golfer 50 may drive golf ball 52. The sides of net 26 suspended from ropes 32 hang to the ground and are maintained in contact with the ground using weights. The lower edge of net 26 is weighted using weighted rope (best seen in FIG. 6), such as lead line, by weaving the weighted rope through the mesh of the net. The weighted rope prevents the force of a driven ball lifting the net off the ground, thus preventing the ball from leaving the enclosure. Net 26 is not, however, pulled taught, as it must be free to move to absorb the energy from golf ball 52 so as to arrest the flight of golf ball 52 when driven into the practice net by golfer 50.

In one embodiment, an auxiliary rectangular target net (not shown) may be suspended between ropes 32 close to the apex of net 26 near rear lower frame member 46. Such target net is arranged substantially parallel to the front opening of net 26 defined by members 36 and 44. The target net may have a bullseye target painted on it.

Figure 7:
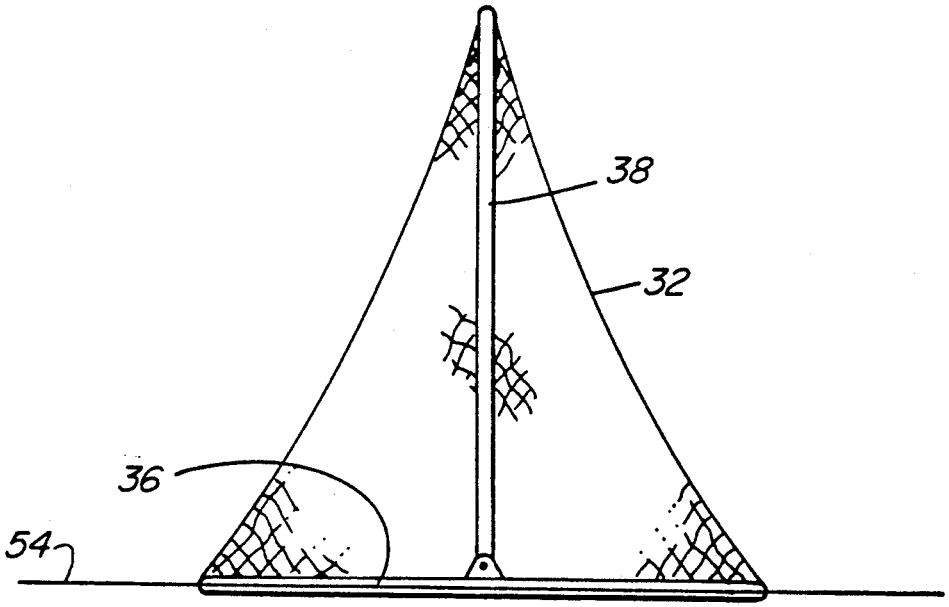
FIG. 7 and 8 are schematic diagrams showing the installation procedure for the invention.
Figure 8:
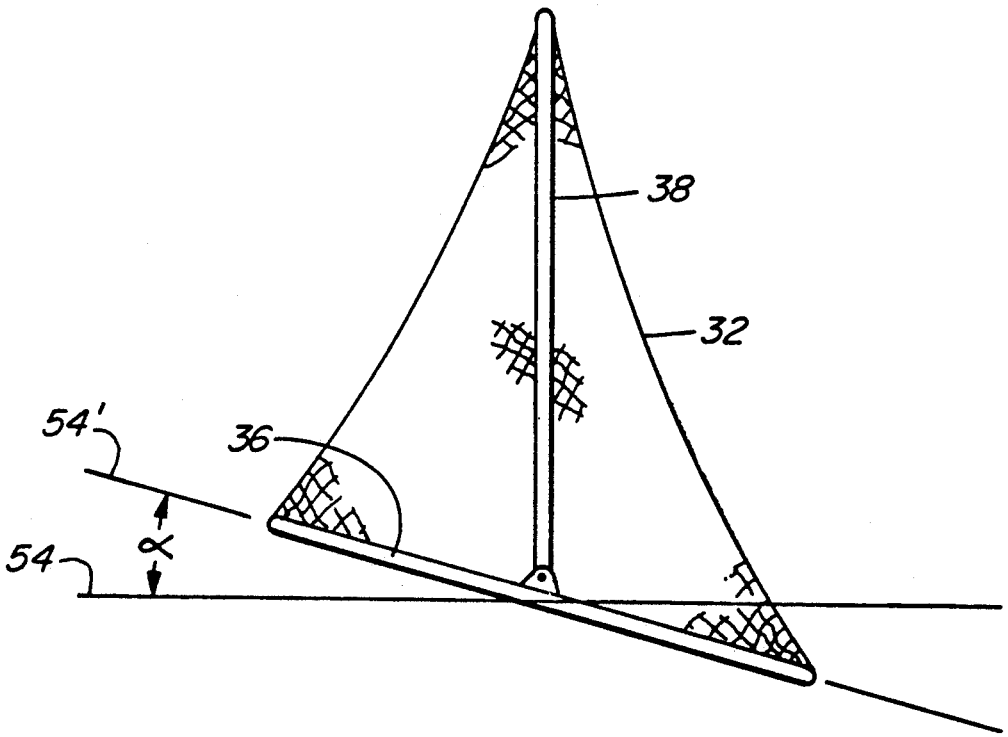

As shown in FIGS. 7 through 8, the front subframe comprising members 36 and 44 is displaced angularly relative to rear frame member 38 in order to allow golfer 50 to complete his golf swing without the risk of the swing follow-through hitting one of the frame members. The pivotable connection between the front subframe 36, 44 and the longitudinal leg 38 allows the front opening of the net to be rotated with respect to the longitudinal leg about a vertical axis. Such rotation is illustrated in plan view in FIGS. 7 and 8. FIG. 7 shows the net and frame configuration before rotation, subframe 36, 44 lying in the plane containing line 54'. FIG. 8 shows the net and frame configuration after rotation so that subframe 36, 44 has been rotated to lie in the plane containing line 54'.

The front subframe is rotated to the position shown in FIG. 8 so that a golf swing follow-through will be unimpeded by the front subframe member 36, 44 on the side closest to the follow-through if golfer 50 stands astride imaginary line 54'. Line 54' crosses the ground defined by the front subframe demarcating the front lip of the receptacle.

The rotation of subframe 36, 44 allows the golfer to swing freely without requiring that the net enclosure be large enough to fully enclose the volume defined by the entire golf swing. That is, the half of the front subframe member 36, 44 on the side corresponding to the golf swing follow-through is rotated in a rearward direction away from the golfer so as to be clear of the arc described by the golfer's golf club in the swing follow-through. The other half of front subframe member 36, 44 is rotated forward an equal distance. This has the effect of moving the leading edge of the receptacle over the golf ball tee-off position. Thus, if the golf ball is either severely sliced, so that it veers sharply to the left or right, or if the golf ball is chipped so that it is directed abruptly upwards, the ball will still remain within the receptacle.

It has been found that an acute angle of $\alpha$ of approximately 10–15 degrees is usually sufficient to allow golfer 50 to complete a golf swing follow-through when golf ball 52 is teed-off from a point on imaginary line 54' between front lower frame members 44.

In order to disassemble the golf swing practice net, the assembly procedure described above is reversed. The golfer may quickly break down the practice net into seven easily stored pieces; namely, the front lower frame members 44, the rear lower frame member 46, the front upper frame members 36, the rear upper frame member 38 and "T"-junction 10 (on which net 26 is retained in an orderly fashion by ring retainer 34).

While in use, the golf swing practice net may be adjusted to suit left or right-handed golfers or golfers using clubs of differing lengths by merely loosening the tension in ropes 32, pivoting the front subframe to the desired angle relative to the rear frame members, and retensioning ropes 32.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A golf swing practice device comprising:

a) a frame comprising first and second frame elements, said first frame element comprising a first generally horizontally extending member and first and second leg members extending downwardly at opposed ends of said first horizontal member, and said second frame element comprising a second generally horizontally extending member having first and second ends, pivotally connected at said first end thereof to said first horizontal member for rotation about a vertical axis at a point located centrally on said first horizontal member between said opposed ends thereof, and a third leg member extending downwardly from the second end of said second horizontal member;

b) a net having a mesh adapted to prevent passage of a golf ball; and c) flexible means extending between said second end of said second horizontal member and each of said opposed ends of said first horizontal member for suspending said net from said frame, the length of said flexible means between said second end of said second horizontal member and either of said opposed ends being adjustable.

2. The device of claim 1 wherein said pivotal connection to said second generally horizontally extending member to said first horizontal member comprises a pivotable "T"-junction coupling member releasably mountable between said second generally horizontal extending member and said first horizontal member.

3. The device of claim 2 wherein said "T"-junction coupling member comprises a first coupling member forming the base leg of the "T" for lockably releasable coupling to said second generally horizontally extending member, and a second coupling member forming the top of the "T", pivotally coupled to said first coupling member, for lockably releasable coupling to said first horizontal member.

4. The device of claim 3 wherein said flexible means comprises a releasably adjustable rope.

5. The device of claim 4 wherein said releasably adjustable rope is tensioned by tensioning means which are releasably slidable along said rope.

6. The device of claim 5 wherein said tensioning means is a releasably slidable toggle.

7. The device of claim 5 wherein said net has a front opening end and is slidably mountable to said first frame element by rings attached to said front end of said net.

8. The device of claim 7 wherein said rope is slidably mountable to said frame by rings attached to said rope.

9. The device of claim 8 wherein said net is suspended from said rope by weaving said rope through said mesh of said net, so that said net may hang naturally from said rope to form a wedge-shaped golf ball receptacle.

10. The device of claim 9 wherein said first frame element is large enough for a golfer to stand upright within said first frame element when said first frame element is in a substantially upright position.

11. The device of claim 10 wherein said first frame element may be rotated through an angular displacement of at least 10–15 degrees relative to said second frame element.

12. The device of claim 11 wherein said "T"-junction coupling member further comprises a means for retaining said rings on said "T"-junction coupling member.

13. The device of claim 11 wherein said flexible means further comprises flexible means extending between said second end of said second horizontal member and said pivotable coupling member.

14. The device of claim 13 wherein said flexible means extending between said second end of said second horizontal member and said pivotable coupling member is a rope.

15. The device of claim 11 wherein said first horizontally extending member and said second horizontally extending member have at their ends from which said leg members extend downwardly, downwardly curved ends for releasable mating engagement with said leg members.

16. The device of claim 11 wherein said first horizontally extending member comprises two opposed generally horizontal members, each of which said two opposed generally horizontal members lockably and releasably mountable to opposed ends of said second coupling member.

17. A golf swing practice device comprising a frame and a net having a mesh adapted to prevent passage of a golf ball, said frame adapted to support said net to form a wedge shape having a planar open end opposite the apex of said wedge, said open end being large enough to receive a standing golfer, the plane of said open end being rotatable with respect to a vertical axis lying in said plane, wherein said frame comprises first and second rigid frame elements, said first rigid frame element comprising a first generally horizontally extending member and first and second leg members extending downwardly at opposed ends of said first horizontal member, and said second rigid frame element comprising a second generally horizontally extending member having first and second ends, pivotally connected at said first end thereof to said first horizontal member for rotation about a vertical axis at a point located centrally on said first horizontal member between said opposed ends thereof, and a third leg member extending downwardly from the second end of said second horizontal member.

18. The device of claim 17 wherein said net forming a wedge shape is supported by said frame and by flexible means extending between said second end of said second horizontal member and each of said opposed ends of said first horizontal member, the length of said flexible means between said second end of said second horizontal member and either of said opposed ends being adjustable.

19. The device of claim 18 wherein said pivotal connection of said second generally horizontally extending member to said first horizontal member comprises a pivotable "T"-junction coupling member releasably mountable between said second generally horizontal extending member and said first horizontal member.

20. The device of claim 19 wherein said "T"-junction coupling member comprises a first coupling member forming the base leg of the "T" for releasable coupling to said second generally horizontally extending member, and a second coupling member forming the top of the "T", pivotally coupled to said first coupling member, for releasable coupling to said first horizontal member.

21. The device of claim 20 wherein said flexible means comprises a releasably adjustable rope.

22. The device of claim 21 wherein said releasably adjustable rope is tensioned by tensioning means which are releasably slidable along said rope.

23. The device of claim 22 wherein said tensioning means is a releasably slidable toggle.

24. The device of claim 22 wherein said net has a front opening end and is slidably mountable to said first frame element by rings attached to said front end of said net.

25. The device of claim 24 wherein said rope is slidably mounted to said frame by rings attached to said rope.

26. The device of claim 25 wherein said net is suspended from said rope by weaving said rope through said mesh of said net, so that said net may hang naturally from said rope to form a wedge-shaped golf ball receptacle.

27. The device of claim 26 wherein said first frame element may be rotated through an angular displacement of at least 10–15 degrees relative to said second frame element.

28. The device of claim 27 wherein said "T"-junction coupling member further comprises a means for retaining said rings on said "T"-junction coupling member.

29. The device of claim 27 wherein said flexible means further comprises flexible means extending between said second end of said second horizontal member and said pivotable coupling member.

30. The device of claim 29 wherein said flexible means extending between said second end of said second horizontal member and said pivotable coupling member is a rope.

31. The device of claim 27 wherein said first horizontally extending member and said second horizontally extending member have at their ends from which said leg members extend downwardly, downwardly curved ends for releasable mating engagement with said leg members.

32. The device of claim 27 wherein said first horizontally extending member comprises two opposed generally horizontal members, each of which said two opposed generally horizontal members lockably and releasably mountable to opposed ends of said second coupling member.

33. A golf swing practice device comprising a frame and a net having a mesh adapted to prevent passage of a golf ball, said frame adapted to support said net to form a wedge shape having a planar open end opposite the apex of said wedge, said open end being large enough to receive a standing golfer, the plane of said open end being rotatable through a displacement of at least 10 degrees relative to said plane about a vertical axis lying in said plane, wherein said frame comprises first and second frame elements, said first frame element comprising a first generally horizontally extending member and first and second leg members extending downwardly at opposed ends of said first horizontal member, and said second frame element comprising a second generally horizontally extending member having first and second ends, pivotally connected at said first end thereof to said first horizontal member for rotation about a vertical axis at a point located centrally on said first horizontal member between said opposed ends thereof, and a third leg member extending downwardly from the second end of said second horizontal member, wherein said pivotal connection of said second generally horizontally extending member to said first horizontal member comprises a pivotable "T"-junction coupling member releasably mountable between said second generally horizontal extending member and said first horizontal member, and said "T"-junction coupling member comprises a first coupling member forming the base leg of the "T" for lockably releasable coupling to said second generally horizontally extending member, and a second coupling member forming the top of the "T", pivotally coupled to said first coupling member, for lockably releasable coupling to said first horizontal member, and wherein said first horizontally extending member comprises two opposed generally horizontal members, each of which said two opposed generally horizontal members lockably and releasably mountable to opposed ends of said second coupling member, wherein said net forming a wedge shape is supported by said frame and by flexible means extending between said second end of said second horizontal member and each of said opposed ends of said first horizontal member for suspending said net from said frame, the length of said flexible means between said second end of said second horizontal member and either of said opposed ends being adjustable, wherein said flexible means comprises a releasably adjustable rope, and said releasably adjustable rope is tensioned by a releasably slidable toggle, and said rope is slidably attached to said frame by rings mounted on said rope, and wherein said net has a front opening end and is slidably mountable to said first frame element by rings attached to said front end of said net, and said net is suspended from said rope by weaving said rope through said mesh of said net, so that said net may hang naturally from said rope to form a wedge-shaped golf ball receptacle.

* * * * *